US005767045A

United States Patent [19]

Ryan

[11] Patent Number: 5,767,045

[45] Date of Patent: Jun. 16, 1998

[54] HYDRAULIC FLUIDS

[75] Inventor: Helen T. Ryan, London, England

[73] Assignee: Ethyl Petroleum Additives Limited, Bracknell, England

[21] Appl. No.: 756,923

[22] Filed: Dec. 2, 1996

[51] Int. Cl.[6] ..... C10M 141/10

[52] U.S. Cl. ..... 508/287; 508/373; 508/375; 508/376; 508/551; 252/78.5

[58] Field of Search ..... 508/287, 373, 508/375, 376

[56] References Cited

U.S. PATENT DOCUMENTS

| | | | |
|---|---|---|---|
| Re. 34,459 | 11/1993 | Bullen et al. | 508/287 |
| 3,920,562 | 11/1975 | Foehr | 252/32.7 E |
| 4,094,800 | 6/1978 | Warne | 252/32.7 E |
| 4,101,429 | 7/1978 | Birke | 252/32.7 E |
| 4,253,977 | 3/1981 | O'Halloran | 508/270 |
| 5,021,176 | 6/1991 | Bullen et al. | 508/287 |
| 5,126,064 | 6/1992 | Barber et al. | 508/287 |
| 5,176,840 | 1/1993 | Campbell et al. | 508/287 |
| 5,190,680 | 3/1993 | Bullen et al. | 508/287 |
| 5,225,093 | 7/1993 | Campbell et al. | 508/287 |
| 5,326,485 | 7/1994 | Cervenka et al. | 508/373 |

FOREIGN PATENT DOCUMENTS

| | | |
|---|---|---|
| 0 020 037 A1 | 12/1980 | European Pat. Off. . |
| 0 389 237 A2 | 9/1990 | European Pat. Off. . |
| 0 399 764 A1 | 11/1990 | European Pat. Off. . |
| 1522961 | 8/1978 | United Kingdom . |

OTHER PUBLICATIONS

Chemical Abstract No. 99:125420 & RO 0077988 B.

*Primary Examiner*—Ellen M. McAvoy
*Attorney, Agent, or Firm*—Dennis H. Rainear; Thomas Hamilton

[57] ABSTRACT

Hydraulic fluid compositions and additive concentrates are described that provide improved wet filtrability. The additive components comprise a mixture formed from at least (a) a zinc dihydrocarbyl dithiophosphate anti-wear agent, (b) a succinimide compound, and optionally (c) one or more alkali metal or alkaline earth metal-containing detergents.

10 Claims, No Drawings

HYDRAULIC FLUIDS

The present invention relates to hydraulic fluids having improved wet filtrability.

It is a requirement of hydraulic fluids that they exhibit acceptable hydraulic performance, i.e. power transmission, as well as other important characteristics such as thermal stability, rust inhibition and anti-wear performance. These latter properties are usually achieved by incorporating specific additives in an hydraulic base oil. Further, to maintain good power transmission and to avoid damaging hydraulic equipment in which they are used, hydraulic fluids should be kept meticulously clean and free of contaminants. To this end detergents are frequently incorporated in the base fluid. Contamination is also minimised by filtration of hydraulic fluids. To ensure that the fluid is substantially free of contaminants very fine filters are used.

As anti-wear agents, zinc dihydrocarbyl dithiophosphates (ZDDPs) are commonly used but there can be some difficulty in achieving the desired level of thermal stability. In the past this has been remedied by carefully controlling the ZDDP production process, by post-treatment of the ZDDP with zinc alkanoates, an overbased zinc octanoate being favored (see GB-A-1,142,195), or by the inclusion in the fluid of an overbased detergent, such as an alkali metal or alkaline earth metal-containing detergent. It has been observed however that exposure of hydraulic fluids containing ZDDP and this kind of detergent to moisture or water vapor can lead to clogging of the filters which are used to maintain fluid cleanliness. There is a further problem with using zinc-containing anti-wear additives in hydraulic fluids in that when exposed to water/moisture at elevated temperatures their anti-wear performance is reduced. It is therefore desirable to provide an hydraulic fluid which does not suffer these disadvantages.

As already mentioned, it is a further important characteristic of hydraulic fluids that they exhibit rust inhibition. This can be achieved using a variety of fluid additives but recent attention has been upon reaction products of monocarboxylic acids, polyalkylene polyamines and alkenyl succinic anhydrides, as described in U.S. Pat. No. 4,101,429. Unfortunately, while such products can give the desired level of rust inhibition, they tend to interact with the kind of detergents which are also incorporated in hydraulic fluids. This interaction leads to the production of degradation products which also cause filter clogging. This problem is particularly prevalent when the hydraulic fluid contains water. It is thus also desirable to provide an hydraulic fluid which exhibits comparable rust inhibition to an hydraulic fluid containing the kind of reaction products described above and which has good wet filtrability, even in the presence of the commonly used detergent additives.

Filtrability of hydraulic fluids which contain water is termed "wet filtrability" and fluids which avoid filter-clogging are said to exhibit improved wet filtrability.

It has now been found that hydraulic fluids in accordance with the present invention are ones which do not tend to generate materials that clog filters and which resist ZDDP breakdown when the fluid is exposed to water. It has further been found that the hydraulic fluids of the present invention exhibit an excellent degree of rust inhibition and do not interact adversely with detergent additives of the kind commonly used in such fluids. The degree of rust inhibition observed is at least comparable to that achieved using the otherwise favored rust inhibitor additives.

Accordingly, the present invention provides an hydraulic fluid comprising:

(a) an hydraulic grade zinc dihydrocarbyl dithiophosphate anti-wear agent;

(b) from 0.03 to less than 1% by weight of a compound of formula:

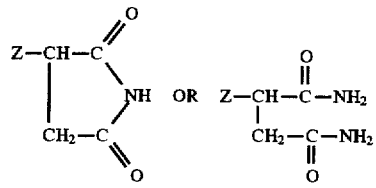

in which Z is a group $R_1R_2CH$— in which $R_1$ and $R_2$ are each independently straight- or branched-chain hydrocarbon groups containing from 1 to 34 carbon atoms and the total number of carbon atoms in the groups $R_1$ and $R_2$ is from 11 to 35; and optionally (c) one or more alkali metal or alkaline earth metal-containing detergents.

The hydraulic fluid of the invention may contain any conventional additional components subject to the need to avoid using reaction products such as those described in U.S. Pat. No. 4,101,429 as noted above and of course subject to the normal requirements for overall compatibility of the composition.

The ZDDPs used in the present invention are of hydraulic grade. This means that they are suitable for use in hydraulic applications, particularly with respect to their thermal stability. ZDDPs which have insufficient thermal stability tend to degrade rapidly to breakdown products which can be corrosive, in particular towards copper. This is a serious problem as certain hydraulic system components are made of this metal. Furthermore, the breakdown products can cause sludge formation which in turn can result in filter blocking. Thus, not all types of ZDDPs are suitable for use in the present invention.

It is generally possible to characterise those ZDDPs which are useful in the present invention by reference to their overbased to neutral ratio or by their titratable base number (TBN). Useful ZDDPs typically exhibit an overbased to neutral ratio of from 0.3:1 to 2:1, preferably 0.5:1 to 2:1. ZDDPs having an overbased to neutral ratio of about 1:1 are more commonly used. The ratio in question is determined by $^{31}P$ nmr.

In terms of TBN, useful ZDDPs generally exhibit a minimum value of about 10 mgKOH/g and preferably about 12 mqKOH/g. ZDDPs having a TBN of about 15 mgKOH/g are more commonly used. TBN is determined in accordance with ASTM D664.

Alternatively, it is generally possible to characterise ZDDPs which may be used by reference to the thermal stability of the finished hydraulic fluid in which they are included. Here reference may be made to the ASTM D2619 and CCM 'A' thermal stability tests. To meet the requirements of the ASTM D2619 test the finished fluid should give a maximum copper loss of 0.2 mg. To pass the CMC 'A' test the finished fluid should give a maximum copper rod rating of 5 and a maximum sludge deposit of 25 mg/100 ml. The ASTM D2619 and CCM 'A' tests are well known in the art.

It is possible to improve the thermal stability of the hydraulic fluid by post-treatment of the ZDDP component using a zinc alkanoate. Typically the alkanoate is branched on its β-carbon atom. Such components are described in European patent application no. 95306722.0. The use of zinc octanoate is preferred, especially an overbased zinc octanoate such as zinc octanoate 22% which is commercially available under this designation.

Zinc dihydrocarbyl dithiophosphates which may be used in the present invention are well-known in the art (see for example U.S. Pat. No. 4,101,429). Suitably the zinc dihydrocarbyl dithiophosphate is a zinc dialkyl dithiophosphate typically containing about 4 to about 12 carbon atoms and, more commonly about 6 to about 12 carbon atoms in each alkyl group. Preferably each alkyl group contains about 8 to about 12 carbon atoms. Examples of suitable alkyl moieties include butyl, sec-butyl, isobutyl, tert-butyl, pentyl, n-hexyl, sec-hexyl, n-octyl, 2-ethylhexyl, decyl and dodecyl. Preferably each alkyl moiety is 2-ethylhexyl. Zinc dialkyl dithiophosphates of this type are described in European patent application no. 95306722.0 and are commercially available.

The ZDDP may be used in the hydraulic fluid over a broad weight range. It is usual however that the fluid contains about 0.4 to about 0.9% by weight ZDDP. Preferably the fluid comprises 0.6% by weight ZDDP.

In the compound (b) the radical Z may be, for example, 1-methylpentadecyl, 1-propyltridecenyl, 1-pentyltridecenyl, 1-tridecylpentadecenyl or 1-tetradecyleicosenyl. Preferably the number of carbon atoms in the groups $R_1$, and $R_2$ is from 16 to 28 and more commonly 18 to 24. It is especially preferred that the total number of carbon atoms in $R_1$ and $R_2$ is about 20 or about 22. The compound is preferably the succinimide shown, the preferred succinimide being a 3-$C_{18-24}$ alkenyl-2,5-pyrrolidindione. A sample of this succinimide contains a mixture of alkenyl groups having from 18 to 24 carbon atoms.

In one aspect of the invention the compound (b) has a titratable acid number (TAN) of about 80 to about 140 mgKOH/g, preferably about 110 mgKOH/g. The TAN is determined in accordance with ASTM D664.

The compounds (b) are commercially available or may be made by the application or adaptation of known techniques (see for example EP-A-0389237).

The hydraulic fluid of the invention comprises from 0.03 to less than 1% by weight of the compound (b), preferably from 0.03 to 0.1% by weight and most preferably about 0.06% by weight.

According to a preferred embodiment, the hydraulic fluid comprises an alkali metal or alkaline earth metal-containing detergent, or mixture thereof. As such, sodium or calcium-containing detergents may be mentioned as examples, especially calcium phenate and calcium salicylate. Detergents of this kind are known and readily available. For example, calcium containing detergents are described in U.S. Pat. No. 5,326,485.

In a particular aspect, the hydraulic fluid comprises calcium phenate, calcium salicylate and sodium sulphonate detergents, suitably in the weight ratio 0.25:0.25:1 to 5.0:5.0:1.0, for example 0.6:0.6:1.0 to 1.8:1.8:1.0, more preferably 0.8:0.8:1.0 to 1.6:1.6:1.0. Suitably this combination is included in the hydraulic fluid at 0.003 to 0.05% by weight, for example 0.005 to 0.025% by weight, preferably 0.007 to 0.014% and, most preferably, at 0.0085 to 0.012% by weight.

Other preferred components which may be included in the hydraulic fluid are dispersants such as Mannich bases and other conventional dispersants, antioxidants such as phenolic and amino-antioxidants, corrosion inhibitors, particularly those that exhibit corrosion of copper metal such as alkylated benzotriazoles and sulphur scavengers such as triaryl phosphites. All these are conventional components of hydraulic fluids and other functional and lubricating oils.

The fluid is made by simple blending of the various components with a suitable base oil. Any of the conventional base oils used for hydraulic formulations may be used.

For the sake of convenience, components (a), (b) and optionally (c) may be provided as a concentrate suitable for formulation into a hydraulic fluid ready for use. Such a concentrate forms part of the present invention. Concentrates of this kind are typically used at a treat rate of about 0.5 to about 1.5% by weight. The concentrate comprises, in addition to the fluid components, a solvent or diluent for the fluid components. The solvent or diluent should, of course, be miscible with and/or capable of dissolving in the hydraulic base fluid to which the concentrate is to be added. Suitable solvents and diluents are well-known. The solvent or diluent may be the hydraulic base oil itself. The concentrate may suitably include any of the conventional additives used in hydraulic fluids. The proportions of each component of the concentrate is controlled by the intended degree of dilution, though top treatment of the formulated fluid is possible.

Also forming part of the present invention is the use of a compound (b) as described herein for improving the wet filtrability of hydraulic fluids comprising an hydraulic grade zinc dihydrocarbyl dithiodiphosphate anti-wear agent, said fluid being substantially free of a reaction product of a monocarboxylic acid, a polyalkylene polyamine and an alkenyl succinic anhydride, for example the reaction product formed by reaction of oleic acid, triethylene tetramine and maleic anhydride substituted by a $C_{12}$ alkenyl group. This reaction product is a rust inhibitor of the kind described in U.S. Pat. No. 4,101,429.

The invention will now be illustrated by the following Examples which are not intended to limit the scope of the invention in any way.

EXAMPLE 1

Hydraulic fluid

The following concentrate was prepared by conventional methods:

| Component | Parts by Weight Example 1 |
|---|---|
| ZDDP (a) | 60.00 |
| $C_{18-24}$ alkenyl succinimide (b) | 6.00 |
| Calcium phenate (c) | 1.00 |
| Calcium salicylate (c) | 1.40 |
| Sodium sulphonate (c) | 1.00 |
| Mannich dispersant | 0.10 |
| Copper corrosion inhibitor | 0.01 |
| Phenolic antioxidant | 19.00 |
| Amine antioxidant | 4.00 |
| Demulsifier | 0.75 |
| Triphenylphosphite (sulphur scavenger) | 1.00 |
| Process Oil | 5.74 |
| Total (wt %) | 100.00 |

The ZDDP used was zinc di(2-ethylhexyl) dithiophosphate. The alkenyl succinimide used was 3-$C_{18-24}$ alkenyl-2,5-pyrrolidindione.

This concentrate was formulated to a hydraulic fluid by dilution with an ISO 46 viscosity grade base oil consisting of a mixture of 150 SN oil (63.00%) and 600 SN oil (37.00), available from ESSO. The treat rate of the concentrate was 0.85% by weight.

Example 2 and Comparative Examples 1 and 2

The hydraulic fluid concentrates shown in the following table were prepared by conventional methods. The concentrates were then formulated into hydraulic fluids by blending with base oil as in Example 1 at a treat rate of 0.85% by weight.

The wet filtrability of each fluid was assessed using the Afnor E48-691 (wet) test. In the latter a water-treated fluid is filtered under conditions of constant pressure and temperature through a membrane with a determined absolute stopping power.

The filtrability index of the fluid IF is defined for a given fluid by the ratio:

$$IF = \frac{T_{300} - T_{200}}{2(T_{100} - T_{50})}$$

in which $T_{300}$ is the passage time, through the membrane, of 300 $cm^3$ of fluid, $T_{200}$ is the passage time, through the membrane, of 200 $cm^3$ of fluid, $T_{100}$ is the passage time, through the membrane, of 100 $cm^3$ of fluid, $T_{50}$ is the passage time, through the membrane, of 50 $cm^3$ of fluid.

The IF ratio therefore consists of comparing the filtration speeds of the fluid in the course of the test. The ratio as well as the filtration speed of the various segments for each sample are indicative of the ease of filtration of the fluid. An IF value of less than 1 indicates a fault in the test method. The closer the IF value to 1, the better the filtrability of the fluid. If during testing the membrane becomes clogged an abort result is recorded.

The tendency of the hydraulic fluid to cause rusting was assessed using the ASTM D665B test. In this test a steel blank is cleaned by rotation at 1700 rpm in contact with 150 grade aluminium oxide cloth and then with 280 grade cloth. A PTFE holder is attached to the blank and this assembly completely immersed in a test tube containing the fluid under test. 300 ml of test fluid is poured into a 400 ml beaker, the beaker having been cleaned first using detergent solution, rinsed with distilled water and dried in an oven for about 15 minutes. The beaker is then placed in an oil bath (set to 60° C.) to which a perspex cover is attached. A stirrer is lowered into the test fluid through a hole in the top of the cover and the fluid stirred. After about 30 minutes the steel blank is removed from the test tube and allowed to drain briefly before placing into the beaker. After a further 30 minutes, 30 ml of synthetic sea water solution is added to the test fluid in the beaker. After 24 hours the steel blank is removed from the test fluid allowed to drain, rinsed with heptane and assessed according to the following rating system:

| Component | Parts by Weight | | |
|---|---|---|---|
| | Example 2 | Comparative Example 1 | Comparative Example 2 |
| $C_{18-24}$ alkenyl succinimide (b) | 6.00 | — | — |
| Rust inhibitor | — | 10.00 | 1.00 |
| ZDDP (a) | 53.00 | 53.00 | 53.00 |
| Calcium phenate (c) | 1.00 | 1.00 | 1.00 |
| Calcium salicylate (c) | 1.40 | 1.40 | 1.40 |
| Sodium sulphonate (c) | 1.00 | 1.00 | 1.00 |

-continued

| Component | Parts by Weight | | |
|---|---|---|---|
| | Example 2 | Comparative Example 1 | Comparative Example 2 |
| Mannich dispersant | 0.10 | 0.10 | 0.10 |
| Copper corrosion inhibitor | 0.01 | 0.01 | 0.01 |
| Phenolic antioxidant | 25.00 | 25.00 | 25.00 |
| Amine antioxidant | 4.00 | 4.00 | 4.00 |
| Demulsifier | 0.75 | 0.75 | 0.75 |
| Triphenylphosphite | 1.00 | 1.00 | 1.00 |
| Process Oil | 6.74 | 2.74 | 11.74 |
| Total (wt %) | 100 | 100 | 100 |
| Treat Rate % | 0.85 | 0.85 | 0.85 |
| IF Afnor (wet) | 1.35 | Aborted | Aborted |
| D665B | Pass | Pass | Mod |

PASS: No rusting.
LIGHT: Not more than six rust spots, each of which is less than 1 mm in diameter.
MODERATE: More than six spots, but confined to less than 5% of the surface of the blank.
SEVERE: Rust covering more than 5% of the surface of the blank.

The ZDDP used was zinc di(2-ethylhexyl) dithiophosphate. The alkenyl succinimide used was the same as in Example 1.

In Comparative Examples 1 and 2 the rust inhibitor used was a mixture of reaction products of oleic acid, triethylene tetramine and maleic anhydride substituted by a $C_{12}$ alkenyl group. This compound is representative of the kind of rust inhibitor compounds described in U.S. Pat. No. 4,101,429.

The results demonstrate that the fluid in accordance with the present invention gives excellent results in the Afnor wet filtrability and the ASTM D665B rust tests. Comparative Example 1 gives an adequate result in the rust inhibition test but an abort result in the Afnor wet test. This means that the samples used caused clogging of the filter membrane. This is due to the presence of contaminants. The latter are believed to be produced by interaction of the detergent components with the rust inhibitor.

In Comparative Example 2 the amount of rust inhibitor was reduced to 1.00 wt %. This was done in an attempt to improve on the Afnor result of Comparative Example 1. As the table shows, the ASTM D665B result for the fluid of Comparative Example 2 was made worse with no improvement in Afnor performance, an abort result still being recorded. Thus, even at reduced levels of rust inhibitor, the problem of filter clogging is still pronounced. This further confirms the efficacy of the hydraulic fluids in accordance with the present invention.

I claim:

1. A hydraulic fluid comprising: a major amount of (i) a hydraulic base oil and (ii) a minor amount of an additive composition comprising (a) a hydraulic grade zinc dihydrocarbyl dithiophosphate anti-wear agent having a TBN of at least 10 mgKOH/g;

(b) from 0.03 to less than 1% by weight of a compound of formula:

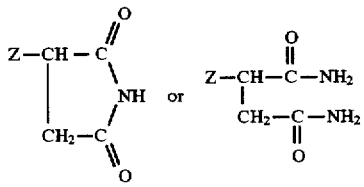

in which Z is a group $R_1R_2CH$— in which $R_1$ and $R_2$ are each independently straight- or branched-chained hydrocarbon groups containing from 1 to 34 carbon atoms and the total number of carbon atoms in the groups $R_1$ and $R_2$ is from 11 to 35; and optionally one or more alkali metal or alkaline earth metal-containing detergents.

2. A fluid according to claim 1 comprising from about 0.01 to about 0.1% by weight of compound (b).

3. A fluid according to claim 1, wherein in the compound (b) the total number of carbon atoms in the groups $R_1$ and $R_2$ is 18 to 24.

4. A fluid according to claim 1, wherein the compound (b) is 3-$C_{18-24}$alkenyl-2,5-pyrrolidindione.

5. A fluid according to claim 1 comprising from about 0.4 to about 0.9% by weight zinc dihydrocarbyl dithiophosphate (a).

6. A fluid according to claim 1, wherein the zinc dihydrocarbyl dithiophosphate is a zinc dialkyl dithiophosphate in which each alkyl group contains from about 6 to about 12 carbon atoms.

7. A fluid according to claim 6, wherein the zinc dihydrocarbyl dithiophosphate is zinc di(2-ethylhexyl) dithiophosphate.

8. A fluid according to claim 1 comprising calcium phenate, calcium salicylate and sodium sulphonate detergents.

9. An additive concentrate comprising: (i) a diluent oil and (ii) an additive composition comprising (a) a hydraulic grade zinc dihydrocarbyl dithiophosphate anti-wear agent having a TBN of at least 10 mgKOH/g;

(b) from 0.03 to less than 1% by weight of a compound of formula:

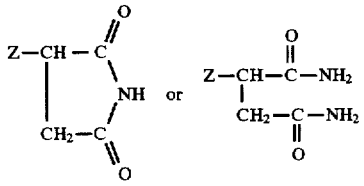

in which Z is a group $R_1R_2CH$— in which $R_1$ and $R_2$ are each independently straight- or branched-chained hydrocarbon groups containing from 1 to 34 carbon atoms and the total number of carbon atoms in the groups $R_1$ and $R_2$ is from 11 to 35; and optionally (c) one or more alkali metal or alkaline earth metal-containing detergents.

10. A method for improving the wet filtrability of a hydraulic fluid comprising adding to said hydraulic fluid:

(a) a hydraulic grade zinc dihydrocarbyl dithiophosphate anti-wear agent having a TBN of at least 10 mgKOH/g;

(b) from 0.03 to less than 1% by weight of a compound of formula:

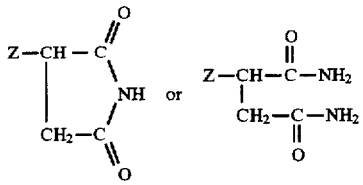

in which Z is a group $R_1R_2CH$— in which $R_1$ and $R_2$ are each independently straight- or branched-chained hydrocarbon groups containing from 1 to 34 carbon atoms and the total number of carbon atoms in the groups $R_1$ and $R_2$ is from 11 to 35; and optionally (c) one or more alkali metal or alkaline earth metal-containing detergents, said fluid being substantially free of a reaction product of a monocarboxylic acid, a polyalkylene polyamine and an alkenyl succinic anhydride.

* * * * *